US008758091B2

(12) United States Patent
Saka et al.

(10) Patent No.: US 8,758,091 B2
(45) Date of Patent: Jun. 24, 2014

(54) CHEMICAL-MECHANICAL POLISHING PAD CONDITIONING SYSTEM

(75) Inventors: Nannaji Saka, Cambridge, MA (US); Thor Eusner, Millwood, NY (US); Jung-Hoon Chun, Sudbury, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 717 days.

(21) Appl. No.: 12/754,645

(22) Filed: Apr. 6, 2010

(65) Prior Publication Data

US 2011/0244764 A1 Oct. 6, 2011

(51) Int. Cl.
*B24B 1/00* (2006.01)
*B24B 21/18* (2006.01)

(52) U.S. Cl.
USPC ..... 451/56; 451/443

(58) Field of Classification Search
USPC ..... 451/56, 60, 443, 444, 446
See application file for complete search history.

(56) References Cited

U.S. PATENT DOCUMENTS

| | | | | |
|---|---|---|---|---|
| 5,976,000 | A | 11/1999 | Hudson | |
| 6,179,693 | B1 * | 1/2001 | Beardsley et al. | 451/56 |
| 6,287,174 | B1 | 9/2001 | Detzel et al. | |
| 6,508,697 | B1 * | 1/2003 | Benner et al. | 451/443 |
| 6,554,951 | B1 | 4/2003 | Page et al. | |
| 7,083,506 | B2 * | 8/2006 | Torii et al. | 451/285 |
| 7,559,824 | B2 * | 7/2009 | Park et al. | 451/11 |
| 2003/0027504 | A1 | 2/2003 | Shipley et al. | |
| 2004/0110381 | A1 | 6/2004 | Yoshida | |
| 2005/0282476 | A1 | 12/2005 | Lujan | |
| 2006/0183410 | A1 | 8/2006 | Yardeni et al. | |
| 2006/0270237 | A1 | 11/2006 | Chuang et al. | |
| 2007/0066189 | A1 * | 3/2007 | Lujan | 451/56 |
| 2007/0087672 | A1 * | 4/2007 | Benner | 451/56 |
| 2007/0281592 | A1 | 12/2007 | Benner | |
| 2009/0224370 | A1 | 9/2009 | Slutz | |

OTHER PUBLICATIONS

The International Search Report and Written Opinion issued in connection with international Patent Application No. PCT/US2011/023564 mailed on May 25, 2011.

* cited by examiner

*Primary Examiner* — Dung Van Nguyen
(74) *Attorney, Agent, or Firm* — Sam Pasternack; MIT Technology Licensing Office

(57) ABSTRACT

Polishing pad conditioning system. The system includes a first rotatable platen supporting a polishing pad containing asperities having a radius of curvature. A second rotatable platen supports a disk of bulk material having holes therethrough, the second rotatable platen supported for translation as well as rotation. Means are provided for pushing the polishing pad and bulk material into contact at an interface during rotation and translation and means are provided for passing a slurry through the holes in the bulk material to the interface whereby the radius of curvature of the pad asperities is increased. Water may be delivered to the bulk material for cooling. A process for conditioning a polishing pad is also disclosed.

16 Claims, 2 Drawing Sheets

CHEMICAL-MECHANICAL POLISHING PAD CONDITIONING SYSTEM

BACKGROUND OF THE INVENTION

This invention relates to chemical-mechanical polishing (CMP) and more particularly to a dedicated polishing pad conditioning machine.

Chemical-mechanical polishing is a process used by semiconductor manufacturers to planarize the surface of an integrated circuit so that the chip can have multiple, flat layers. During the CMP process, a machine is used to press a wafer and a polishing pad into contact at a selected pressure. Both the pad and the wafer are turned at a given rotational velocity and a slurry containing a liquid and abrasive particles is pumped into the interface of the pad and the wafer to increase the material removal rate. In order for the CMP process to be effective, defects on the wafer surface must be kept to a minimum. Recently, scratching of the wafer surface has emerged as the dominant defect during CMP.

The semiconductor manufacturing industry has used a "quick fix" approach to the scratching problem. Currently, the industry uses the chemical-mechanical polishing tool itself to condition a new pad by using the CMP machine to polish approximately 50 Cu-coated wafers that are then discarded later. This procedure is very inefficient because the CMP polishing tool was designed with the sole purpose of polishing wafers, not conditioning polishing pads. Currently, the conditioning process using the CMP polishing machine takes approximately four hours and must be repeated every 24 hours, per polishing machine. Therefore, valuable machine time and costly consumables (i.e., wafers and environmentally-harmful slurry) are wasted.

It is therefore an object of the present invention to provide a machine and process that will enable a new polishing pad to be conditioned apart from the use of the CMP polishing machine. Thus, the CMP polishing machines will not have to experience four hours of downtime every day. Another object of the invention is to accelerate the pad conditioning process by making it more efficient by taking only one-tenth of the previous amount of time and which uses no wafers.

SUMMARY OF THE INVENTION

According to a first aspect, the invention is a polishing pad conditioning system that includes a first rotatable platen supporting a polishing pad containing asperities having a radius of curvature. A second rotatable platen supporting a disk of bulk material is provided that has holes therethrough. The second rotatable platen is supported both for rotation and translation. The system includes means for urging the polishing pad and bulk material into contact at an interface during rotation and translation. Means are also provided for passing a slurry through the holes in the bulk material to the interface whereby the radius of curvature of the pad asperities is increased. In a preferred embodiment the disk of bulk material is made of a metal. In another embodiment, the disk of bulk material is ceramic. Polymers may also be used. In a preferred embodiment, the polishing pad and bulk material are pushed together at a pressure in the range of 1-5 psi (7-35 kPa). It is also preferred that the first and second rotatable platens rotate at a rate in the range of 50-200 rpm. In yet another preferred embodiment, the slurry is approximately 95% water and five percent ceramic particles.

In yet another embodiment, multiple rotatable platens supporting disks of bulk material are provided to cut further the conditioning time. A preferred embodiment includes four rotatable platens.

In another aspect, the invention is a method for conditioning a polishing pad having asperities with a small radius of curvature including rotating the polishing pad while in contact at a selected pressure at an interface with a rotating and translating bulk material containing passages through which a slurry is passed to the interface to increase the radius of curvature of the asperities.

In a preferred embodiment, the selected pressure is in the range of 1-5 psi. In this embodiment the bulk material may be a metal or a ceramic. It is preferred that the polishing pad and bulk material rotate at a rate in the range of 50-200 rpm. A suitable slurry is approximately 95% water and five percent ceramic particles.

In yet another aspect, cooling is provided to dissipate the heat from the conditioning process.

DESCRIPTION OF THE PREFERRED EMBODIMENT

The inventors herein have shown that the primary source of scratching is polishing pad asperities and not due to agglomerated slurry particles. Our research shows that scratching is primarily a function of the pad hardness, coefficient of friction and the radius of curvature of the pad asperities. When a pad is new, the radius of curvature of the asperities is small, on the order of 20 μm. We have determine that in order for pad scratching not to occur, the asperity radius of curvature needs to be increase beyond a certain threshold. A suitable range for asperity radius of curvature is 200-250 μm.

Figure 1:
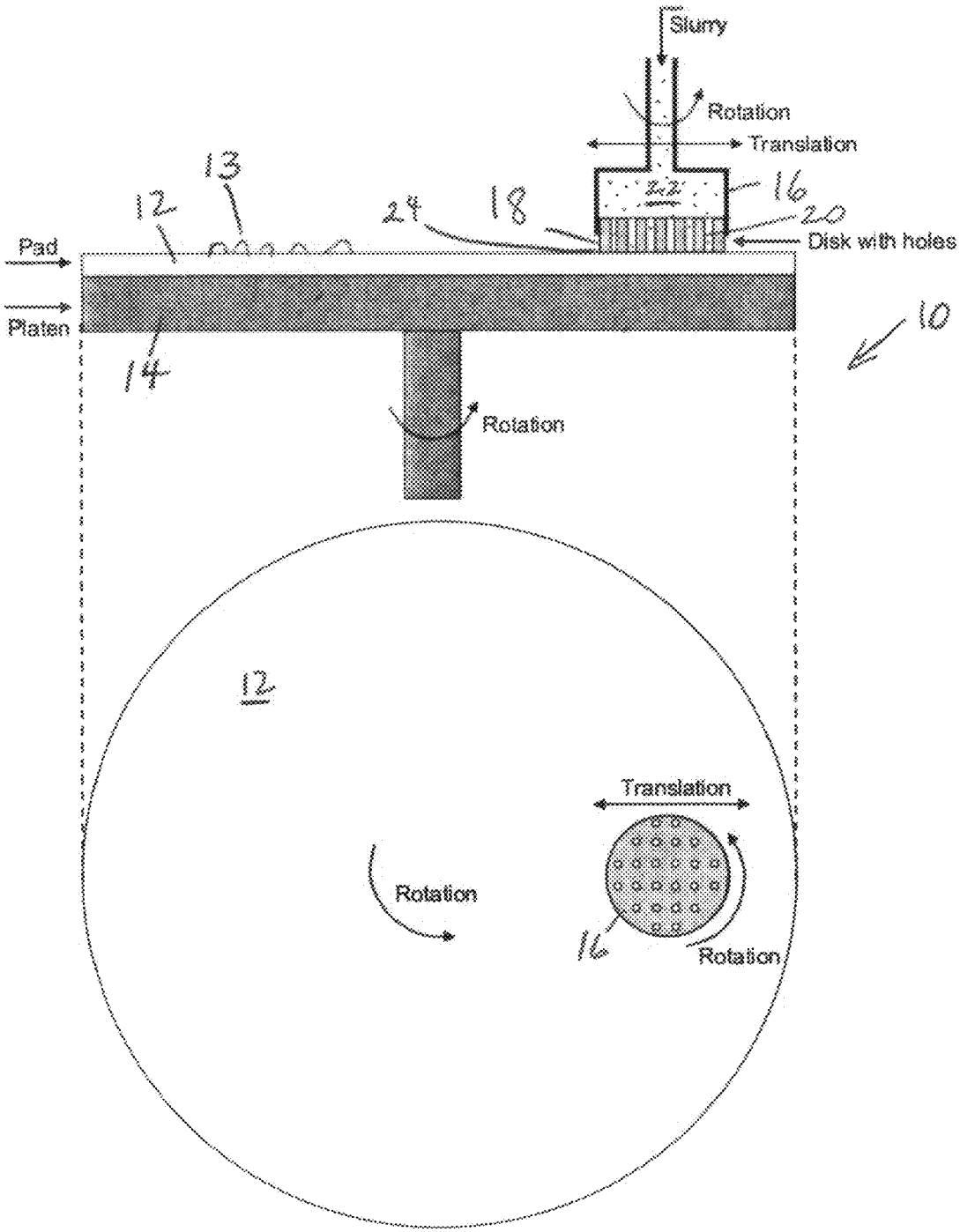
FIG. 1 is a cross-sectional and planar view of an embodiment of the pad conditioning tool disclosed herein.

With respect to FIG. 1, a polishing pad conditioning system 10 includes a pad 12 to be conditioned. The pad 12 includes asperities 13 having a radius of curvature. The asperities 13 are exaggerated in the figure for clarity. Polishing pads 12 are often made of polyurethane. The pad 12 is supported on a rotatable platen 14. Another platen 16 supports a disk 18 of bulk material such as metal or a ceramic, The bulk material 18 includes holes through which a slurry 22 is pumped to an interface 24 between the bulk material 18 and the pad 12. It is preferred that the platen 16 not only be capable of rotating but also of translation as shown in FIG. 1.

As mentioned above, approximately 50 Cu-coated wafers are polished, and then discarded, to condition a pad according to the prior art technique. Each such wafer has a Cu coating having a thickness of about 1 μm so that the total thickness of Cu polished away to condition one pad is approximately 50 μm. Thus if a Cu disk is used in the present invention, approximately 50 μm of the disk will be worn away. If the same disk is used 20 times, then about a millimeter of the disk will be removed. The inventors consider this to be excessive wear.

To minimize the wear rate of the disk, therefore, hard materials should be employed, but copper is still an option. Suitable metals for the disk bulk material include copper, stainless steel, nickel, and titanium. Other metals may also be used.

Suitable ceramics includes alumina ($Al_2O_3$), silica ($SiO_2$), zirconia ($ZrO_2$) and their combinations. Hard coatings suitable for use in the invention include electroless and electroplated hard metals (e.g., copper, nickel) and compounds (e.g., titanium nitride), along with anodic coatings on aluminum and other metals. Other suitable materials include CVD- and PVD-coated compounds such as carbides, nitrides and borides, diamond-like carbon (DLC) and hard-anodized aluminum. Polymers such as high-density polyethylene, nylon and polycarbonate may also be used. Polymers are perhaps not the best choice, however.

It is preferred that the pad 12 and the bulk material 18 be pressed together at contact pressures in the range of 1-5 psi (7-35 kPa). This pressure exceeds the pressure used in the CMP polishing machines themselves which is about 1.5 psi. It is also preferred that the pad and disk rotate with velocities in the range of 50-200 rpm as compared with about 60 rpm in the prior art. A modified slurry may be used if necessary to enhance conditioning, but it will primarily consist of water (95%) and ceramic particles (5%). Thus, environmentally harmful chemicals are not used.

Because of the dedicated machine and process of the invention, it is possible to reduce pad conditioning time to approximately one-tenth that of current conditioning time because of the higher pressures and rotation rates. Furthermore, because the system of the invention employs an independent machine, the polishing machines themselves can continuously operate 24 hours a day without wasting four hours per day to condition a new polishing pad.

Figure 2:
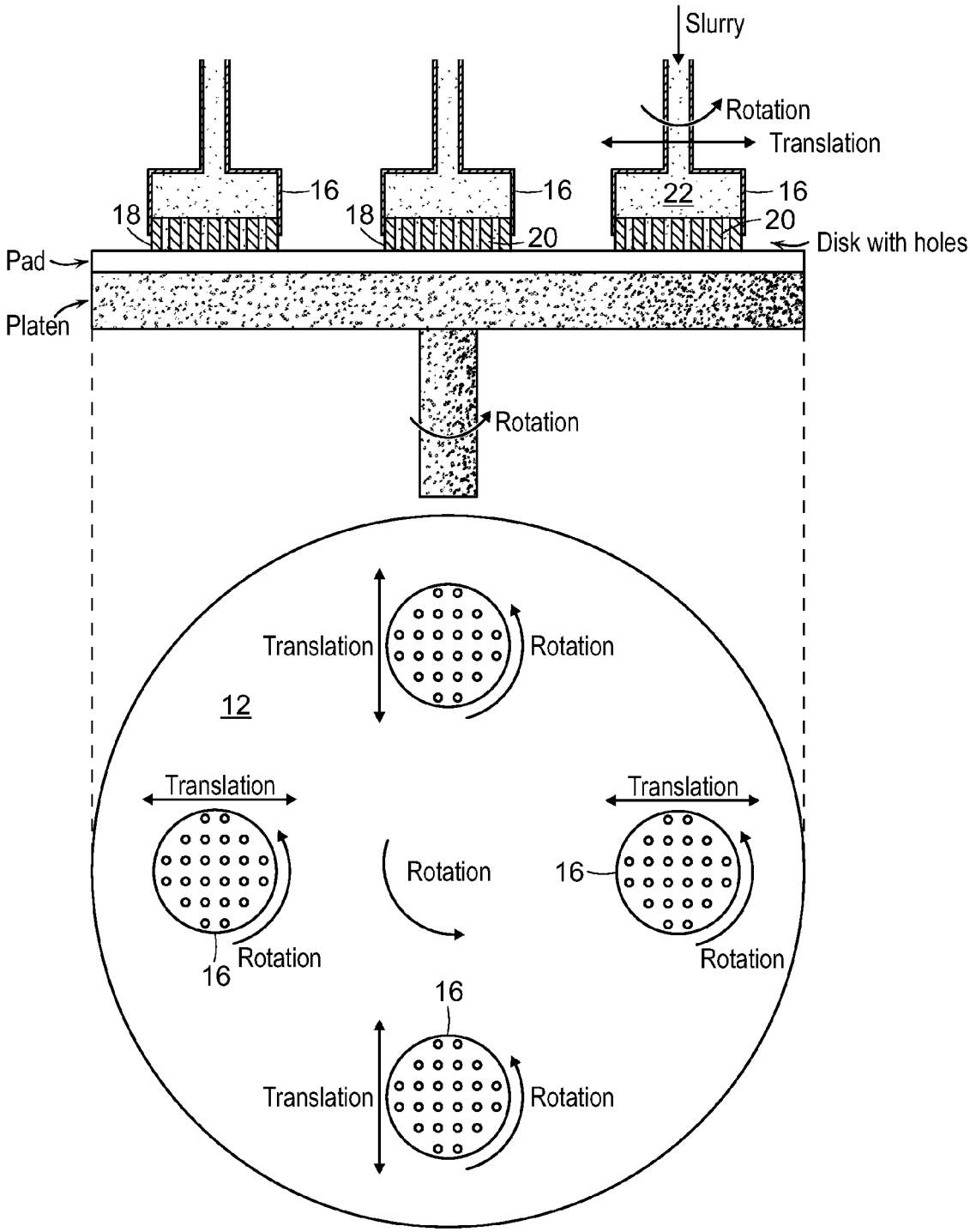
FIG. 2 is a cross-sectional and planar view of another embodiment of the invention.

Conditioning time can be reduced further using the embodiment of the invention shown in FIG. 2 in which multiple rotatable conditioning platens 16 are provided. In the embodiment of FIG. 2, four rotatable platens 16 are shown. More or fewer rotatable platens 16 may be used.

The accelerated conditioning of the invention can lead to heat build-up. Basically, the energy dissipated in four hours in the prior art practice must now be dissipated in about 30 minutes. To dissipate heat, deionized or distilled water (with no abrasive particles) is delivered to the disk near its center as a continuous stream. Because of pad rotation, the water will move away radially thereby cooling the pad.

Because of the dedicated system 10 of the invention, approximately 50 wafers will be saved each day per polishing machine since such wafers are no longer necessary. The dedicated machine of the invention uses thick metal or ceramic disks which will not need to be replaced for several years. Furthermore, the speed with which a pad can be conditioned will be increased by a factor of 10 or more. Thus, only one pad conditioning machine is required to allow several polishing machines to polish continuously. Therefore, for every ten polishing machines (which currently each need to condition for four hours a day), investing in only one conditioning machine is necessary to reap the benefits. Because no environmentally-harmful chemicals are used in the system and process of the invention, there will be a savings on waste disposal as compared to current conditioning practices that use harmful chemicals.

It is recognized that modifications and variations of the invention disclosed herein will be apparent to those of ordinary skill in the art and it is intended that all such modifications and variations be included within the scope of the appended claims.

What is claimed is:

1. Polishing pad conditioning system comprising:

a first rotatable platen supporting a polishing pad containing asperities having a radius of curvature;

a second rotatable platen supporting a disk of bulk material having holes therethrough, the second rotatable platen supported for translation as well as rotation;

means for pushing the polishing pad and bulk material into contact at an interface during rotation and translation; at a contact pressure selected to increase the radius of curvature of the pad asperities to be in range of 200-250 μm; and means for passing a slurry through the holes in the bulk material to the interface.

2. The system of claim 1 wherein the disk of bulk material comprises a metal.

3. The system of claim 1 wherein the disk of bulk material comprises a ceramic.

4. The system of claim 1 wherein the means for pushing the polishing pad and bulk material together provides a pressure in the range of 1-5 psi (7-35 kPa).

5. The system of claim 1 wherein the first and second rotatable platens rotate at a rate in the range of 50-200 rpm.

6. The system of claim 1 wherein the slurry is approximately 95% water and 5% ceramic particles.

7. The system of claim 1 including more than one second rotatable platens.

8. The system of claim 7 including four second rotatable platens.

9. The system of claim 1 further comprising delivering water to the disk for cooling.

10. The system of claim 1 wherein the bulk material is selected from the group consisting of copper, stainless steel, nickel, titanium, alumina, silica, zirconia, electroless and electroplated hard metals such as copper and nickel, CVD- and PVD-coated compounds such as carbides, nitrides and borides, diamond-like carbon and hard-anodized aluminum.

11. Method for conditioning a polishing pad having asperities with a radius of curvature comprising:

rotating the polishing pad while in contact at a selected pressure at an interface with a rotating and translating bulk material containing passages through which a slurry is passed to the interface for a time sufficient to increase the radius of curvature of the asperities to be in the range of 200-250 μm.

12. The method of claim 11 wherein the selected pressure exceeds 20 psi (138 kPa).

13. The method of claim 11 wherein the bulk material is a metal.

14. The method of claim 11 wherein the bulk material is a ceramic.

15. The method of claim 11 wherein the polishing pad and bulk material rotate at a rate greater than 400 rpm.

16. The method of claim 11 wherein the slurry is approximately 95% water and 5% ceramic particles.

* * * * *